United States Patent [19]

Guth et al.

[11] 3,954,116

[45] May 4, 1976

[54] SOUND-DAMPENING CONNECTION

[75] Inventors: Lauren W. Guth; Donald S. Cushing, both of Louisville, Ky.

[73] Assignee: General Electric Company, Louisville, Ky.

[22] Filed: Apr. 1, 1975

[21] Appl. No.: 563,972

[52] U.S. Cl. ..... 134/183; 134/191; 137/247.41; 181/33 S; 415/119

[51] Int. Cl.[2] ..... B08B 3/02; F01N 1/16

[58] Field of Search ..... 137/247.41, 247.45, 137/247.49; 415/119; 181/33 S, 36 D, 37; 134/176, 182, 183, 191

[56] References Cited

UNITED STATES PATENTS

| | | | |
|---|---|---|---|
| 172,117 | 1/1876 | Hardy | 138/37 |
| 816,023 | 3/1906 | Lloyd | 137/247.41 |
| 945,523 | 1/1910 | Hall et al. | 181/52 |
| 1,036,713 | 8/1912 | Rice | 181/57 |
| 1,077,636 | 11/1913 | Paul | 134/72 |
| 1,280,386 | 10/1918 | Buehner | 181/49 |
| 1,333,142 | 3/1920 | Ulmer | 138/37 |
| 1,388,554 | 8/1921 | Dubben et al. | 181/35 |
| 1,980,065 | 11/1934 | Johnston | 134/176 X |
| 2,101,389 | 12/1937 | Fischer | 181/57 |
| 2,632,394 | 3/1953 | Andrews | 415/119 |
| 2,973,716 | 3/1961 | Thomas | 415/119 |
| 3,077,240 | 2/1963 | Betts | 181/52 |
| 3,259,206 | 7/1966 | Straw | 181/59 |
| 3,294,102 | 12/1966 | Ruspino et al. | 134/186 |
| 3,295,541 | 1/1967 | Ummel | 134/182 |
| 3,398,866 | 8/1968 | La Flame et al. | 222/333 |
| 3,398,932 | 8/1968 | Koeller et al. | 415/119 X |
| 3,415,338 | 12/1968 | McMillan | 181/59 |
| 3,438,330 | 4/1969 | Evans | 415/119 |
| 3,568,789 | 3/1971 | Guth | 181/37 X |
| 3,664,759 | 5/1972 | Biheller | 415/121 G |

*Primary Examiner*—Robert L. Bleutge
*Attorney, Agent, or Firm*—Robert W. Fletcher; Francis H. Boos

[57] ABSTRACT

A liquid-containing, trap connection, for connecting a dishwasher tub in fluid flow relationship with a pump inlet, the trap connection having a tongue-like projection, located therewithin, and integrally attached to the connection sidewall above the liquid level in the trap. The tongue-like projection has a free end extending to a point below the liquid level to provide a sound barrier whereby the pump sounds emanating from the inlet side of the pump are muted.

4 Claims, 4 Drawing Figures

SOUND-DAMPENING CONNECTION

BACKGROUND OF THE INVENTION

Automatic electric dishwashers are well known for household use. Such dishwashers have come to be an accepted part of modern, fully-equipped kitchens. As these dishwashers are continually improved upon and perfected, more and more design characteristics become important. Currently, dishwasher manufacturers are striving to make their automatic electric dishwashers operate as quietly as possible. It is to this end that the present invention is directed.

Contemporary, automatic, electric dishwashers include a tub which defines a wash chamber, which tub has a side opening and door pivotally attached to close the side opening, and a pump-motor compartment therebelow. There is, generally, a plurality of superposed dishracks mounted for movement through the opening and a spray means located within the tub to distribute washing liquid over dishes placed in the receiving racks. The tub is provided with an outlet which is in fluid flow relationship with the inlet of the pump-motor arrangement so that liquid may be continuously cycled from the pump outlet through the spray means, to the wash chamber, and returned through the outlet of the tub to the pump inlet.

Normally, the connection between the tub outlet and the pump inlet is steel or other similar durable material. Recently, however, it has been found that by providing a flexible, resilient connection means, made of rubber or some other polymeric resinous material, significant dampening of vibrations from the pump-motor arrangement through the connection to the tub can be accomplished.

However, with such a connection, there is an open sound channel from the pump inlet through the connection means into the tub. The tub, in turn, tends to act as a resonating board to amplify the sound from the pump assembly and transmit it throughout the kitchen area.

Prior art attempts at dampening the sound emanating from a dishwasher pump assembly include U.S. Pat. No. 3,398,866, which provided the pump with a sound-dampening impeller. Another attempt at providing a sound-dampening pump is exemplified in U.S. Pat. No. 2,973,716.

Both of these prior references indicate that reducing the sound emanating from an automatic electric dishwasher has been of concern. However, neither of them suggests the idea of providing a flexible trap connection between the tub drain and the pump inlet and providing a tongue member located therein, as will be more fully described hereinafter.

In a similar vein, structure having a likeness to the present invention is shown in U.S. Pat. No. 1,721,117, wherein it is suggested that a tongue member be enclosed within a T-coupling to serve as a flow divider. However, U.S. Pat. No. 1,721,117 does not suggest the use of a tongue member in combination with a water trap to effect sound dampening.

The invention described herein is an inexpensive, readily-constructed, and easily-maintained liquid trap connection which is effective in dampening sound, emanating from the pump-motor arrangement in a dishwasher.

SUMMARY OF THE INVENTION

The invention includes a liquid-trap-type connection suitable for use in connecting a dishwasher tub drain outlet to a dishwasher pump inlet. The connection can be used to dampen the sound normally emanating from a dishwasher pump. The liquid-trap connection also may be used to facilitate the introduction of air upstream of the dishwasher pump to provide an aerated wash stream, since the area behind the tongue member is an area of naturally occurring partial vacuum which would tend to draw air if connected to an outside air line.

More specifically, the invention includes a dishwasher having a tub with a mouth, opposed sides, and a bottom defining a wash chamber, the tub bottom having an aperture therein, opening into a pump-motor compartment therebelow; a door for closing the tub mouth, a plurality of superposed article-receiving racks mounted for movement through the mouth between washing and loading positions, in and at least partially out of the chamber, respectively; spray means mounted within the tub in liquid-distributing relation to the receiving racks for directing washing liquid toward the racks, a pump-motor arrangement residing below the tub, said pump-motor arrangement further having a pump inlet below the tub bottom, the improvement comprising: a liquid-containing trap connection for connecting the aperture of the tub to the pump inlet in fluid flow relationship, said trap connection including a tongue member within said trap extending from a point above the liquid level in the trap connection and terminating at a free end below the surface of the liquid in the trap connection, to dampen sound from said pump-motor arrangement.

Advantageously, the liquid-containing trap connection is fabricated from a resilient material such as rubber or any one of the commonly known polymeric resinous materials, such as polyethylene, polypropylene, polystyrene, polyurethane, polyvinylchloride, acrylonitrile-butadiene-styrene, and copolymers or combinations thereof, all of which are commonly referred to as plastics.

The liquid-trap connection of this invention has been found to be useful in reducing the sound emanating from the pump of a dishwasher during operation thereof.

DESCRIPTION OF THE PREFERRED EMBODIMENT

Figure 1:
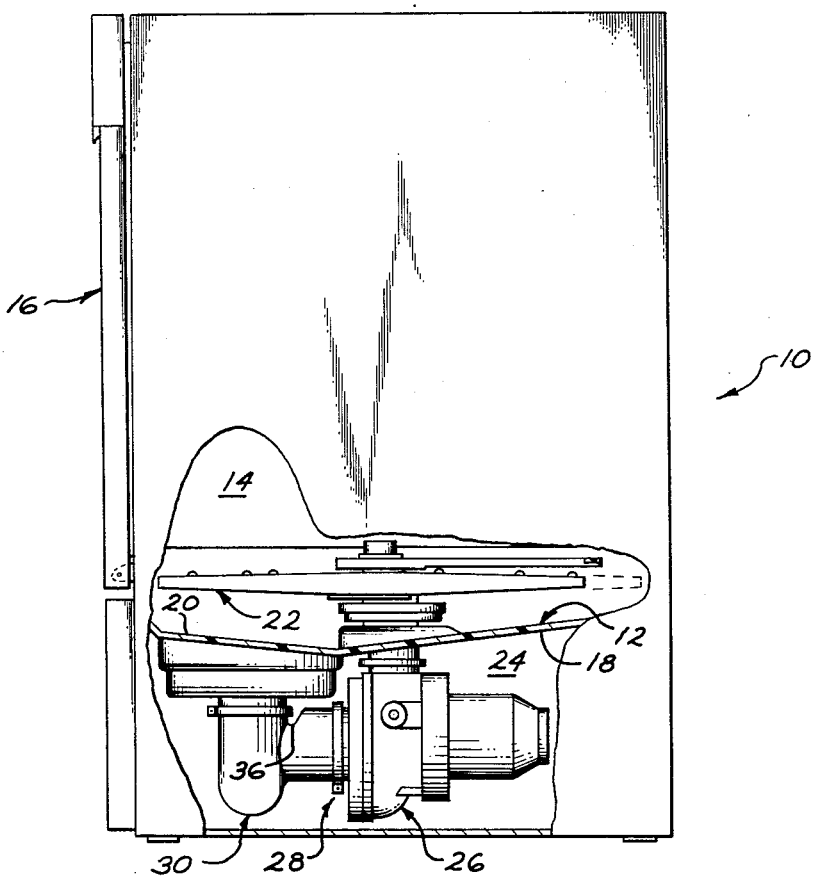
FIG. 1 is a side view, partially cut away, of a dishwasher showing the sound-dampening connection located therein.

Dishwasher 10 includes tub 12 which provides a wash chamber 14. Wash chamber 14 has a mouth closed by door 16. Tub 12 includes tub bottom 18 having an aperture 20 therein. Wash chamber 14 further contains spray means 22 for distribution of washing liquid toward articles located in article-receiving racks (not shown) inside the wash chamber.

Below tub 12 is pump-motor arrangement compartment 24 which houses pump-motor arrangement 26. Pump-motor arrangement 26 includes pump inlet 28.

Sound-dampening connection 30 connects tub aperture 20 to pump inlet 28 in fluid flow relationship. Sound-dampening connection 30 is a liquid-containing trap having a tongue member 32 extending from its upper sidewall portion 34 downwardly, terminating at a point below the liquid level in the trap.

Preferably, the liquid-containing trap is fabricated from a resilient material, as described above, so that during the washing operation of the dishwasher, liquid may flow from the tub to the pump inlet unrestricted by tongue member 32. Thus, if the fabrication material of tongue member 32 is resilient, tongue member 32 will be easily flexed to a position (shown in dashed lines in FIG. 2) where it will not obstruct the flow of washing liquid between the tub and the pump. However, as the liquid flow decreases, such as during the drain cycle of the dishwasher, tongue member 32 may flex downwardly to provide an effective noise barrier for any sounds emanating from the dishwasher pump.

It can be seen that the sound-dampening protection afforded by tongue member 32 will continue after the drain cycle has been completed because tongue member 32 extends downwardly into the liquid in the trap which is not normally removed from the trap during the drain cycle.

Figure 2:
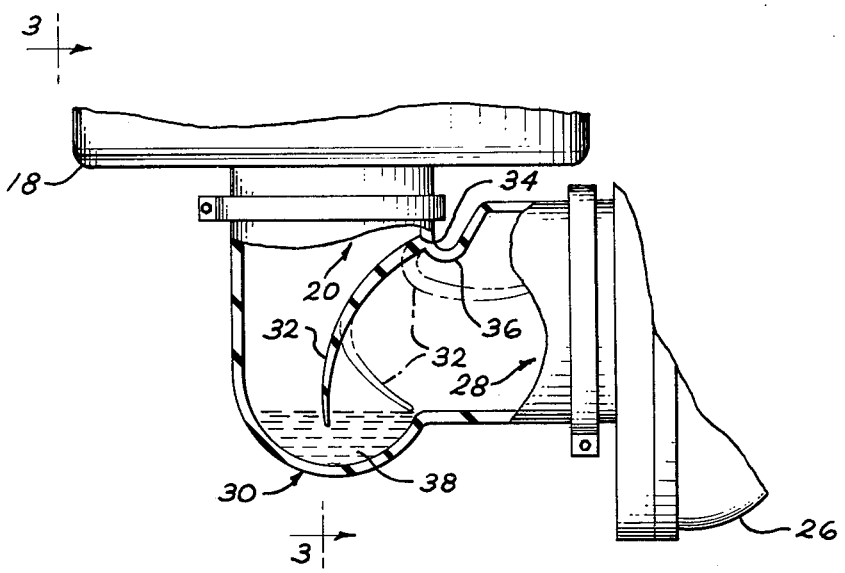
FIG. 2 is an enlarged, cutaway view of the sound-dampening connection shown connecting a dishwasher tub outlet and a pump inlet.

Also, it is preferable that tongue member 32 be thinner at its free end and at its point of attachment to upper sidewall portion 34. Such dimensioning can be accomplished by either providing tongue member with a gentle taper converging toward its free end as shown in FIG. 2 or, in the alternative, it can be of two specific dimensions, the thicker portion being adjacent upper sidewall portion 34 and the thinner, more flexible portion including the free end of the tongue.

The liquid-containing trap 30 preferably has a convolution 36 in its upper sidewall portion to which tongue member 32 is connected. Such an arrangement enables tongue member 32 to be easily and straightforwardly molded, using current molding techniques. Specifically, it can be seen that a core section can be introduced into the center portion of the connection 30 from the direction of tub opening 20 and another core section can be introduced from the direction of the pump inlet 28. In each instance, the circumference of the core portion becomes progressively less as viewed in a direction proceeding toward the well 38 of the trap, thus facilitating the removal of the core sections.

Figure 4:
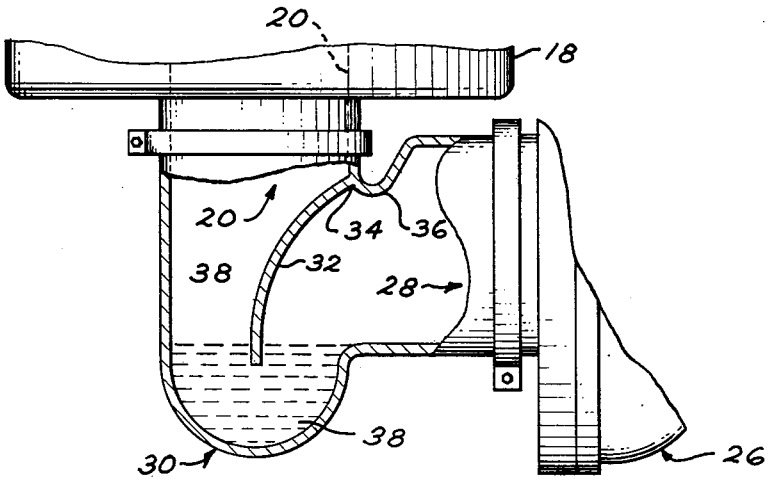
FIG. 4 is a view, similar to FIG. 3, of an alternative embodiment of the sound-dampening connection of this invention.
Figure 3:
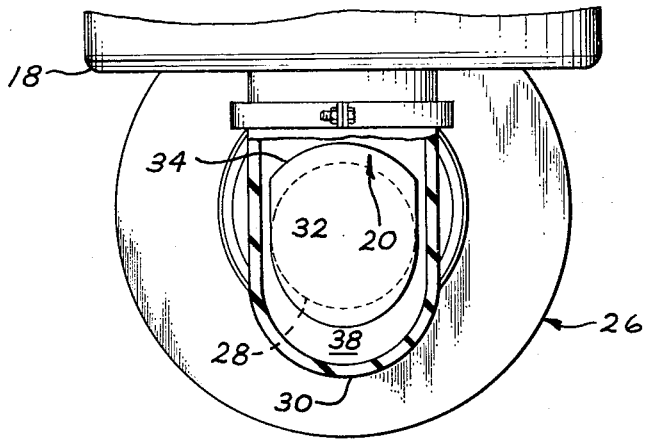
FIG. 3 is a view taken along line 3—3 of FIG. 2.

In the alternative, the liquid-containing trap connection may be fabricated from a rigid material, such as metal or rigid plastic and have resilient seal means on each end (see FIG. 4). Tongue member 32 would then be fixed in position and would have its edges affixed to the inside sidewall of the trap, as well as being affixed to upper sidewall portion 34. In such event, tongue member 32 must be sized and positioned with respect to the connecting sidewalls so that there is, in essence, a constant cross-sectional flow area downwardly between the sidewall and the tongue member, around the end of the tongue member, and into the pump inlet. Such an arrangement of course requires that the liquid-containing trap be deeper than the arrangement shown in FIG. 2 and that it be sized accordingly.

In addition to the sound-dampening function performed by the liquid-containing trap, it also facilitates the pump-priming operating during pump startup, since any slight vacuum drawn by the pump will cause water from the reservoir 36 to be drawn into the pump to begin the priming thereof.

Having thus described the invention, what is claimed is:

1. In a dishwasher having a tub including a mouth, opposed sides, and a bottom defining a wash chamber, the tub bottom having an aperture therein opening into a pump-motor compartment therebelow; a door for closing the tub mouth, a plurality of superposed article-receiving racks mounted for movement through the mouth between washing and loading positions, in and at least partially out of the chamber, respectively; spray means mounted within the tub in liquid-distributing relation to the receiving racks for directing washing liquid toward the racks, a pump-motor arrangement residing below the tub, said pump-motor arrangement further having a pump inlet below the tub bottom, the improvement comprising:

a liquid-containing trap connection for connecting the aperture of the tub to the pump in fluid flow relationship, said trap connection including a tongue member within said trap extending from a point above the liquid level in the trap connection and terminating at a free end below the surface of the liquid in the trap connection to dampen sound from said pump-motor arrangement.

2. The liquid-trap connection of claim 1 wherein said trap and tongue member are resilient and said tongue member can be flexed to reduce interference with liquid flow through said trap connection during dishwasher operation.

3. The liquid-trap connection of claim 2 wherein said tongue member is tapered generally converging toward its free end.

4. The liquid-trap connection of claim 2 wherein said tongue member is comprised of a thicker portion and a thinner portion, the thinner portion including the free end thereof.

* * * * *